United States Patent [19]

Nakajima

[11] 4,185,257

[45] Jan. 22, 1980

[54] QUASIOPTICAL BAND REJECTION FILTER

[75] Inventor: Nobuo Nakajima, Yokosuka, Japan

[73] Assignee: Nippon Telegraph and Telephone Public Corporation, Tokyo, Japan

[21] Appl. No.: 911,574

[22] Filed: Jun. 1, 1978

[30] Foreign Application Priority Data

Jun. 10, 1977 [JP] Japan ..... 52-67820

[51] Int. Cl.[2] ..... H01P 1/20

[52] U.S. Cl. ..... 333/208; 333/211

[58] Field of Search ..... 333/73 R, 73 C, 73 S, 333/73 W, 82 R, 10

[56] References Cited

U.S. PATENT DOCUMENTS 4,034,315 7/1977 Unrau ..... 333/10

FOREIGN PATENT DOCUMENTS 2108687 8/1972 Fed. Rep. of Germany ..... 333/10

OTHER PUBLICATIONS

U. Unrau et al., *Quasioptical Band-Splitting Filter with Extended Bandwidth*, Telecommunications Conference, London, England, 9/1970.

Suzuki, Nobuo, *A New Band-Splitting Filter for Guided Millimeter-Wave Transmission Systems*, IEEE MTT Trans, No. 5, 1976, (May).

Cohen et al., *Dielectric Slab-Interference Filters Having Wide Stop Bands*, Proceedings IEEE, Jul. 1966.

*Primary Examiner*—Alfred E. Smith
*Assistant Examiner*—Harry E. Barlow
*Attorney, Agent, or Firm*—Sughrue, Rothwell, Mion, Zinn and Macpeak

[57] ABSTRACT

One of ports of a 3dB hybrid for dividing and combining electromagnetic waves is used as an input port, and first and second resonators are electromagnetically coupled respectively with two ports to which the electromagnetic waves incident from the input port are outputted after being divided. The first and second resonators respectively comprise pluralities of opposed coupling disks sequentially arranged in the direction of travel of the electromagnetic waves and first and second reflectors disposed opposite the coupling disks farthest from the hybrid. The numbers of coupling disks of the first and second resonators are selected to differ by one. The remaining port of the hybrid is used as an output port.

7 Claims, 14 Drawing Figures

FIG. 2
PRIOR ART
FIG. 1
PRIOR ART
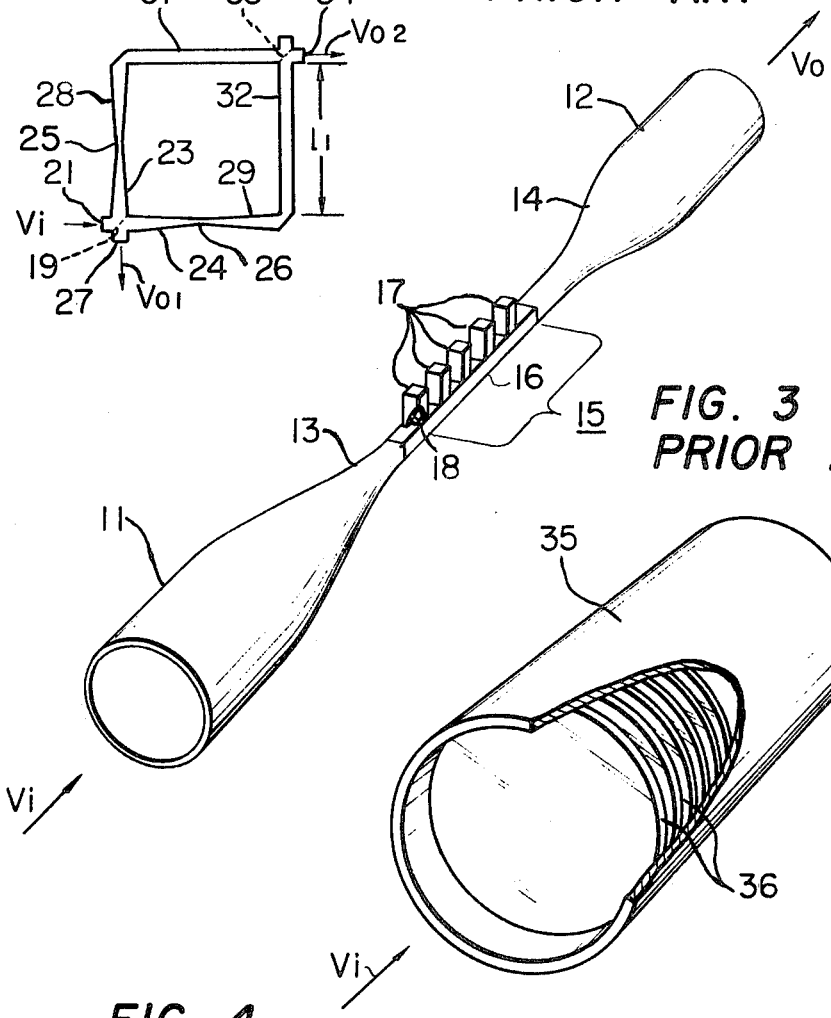
FIG. 3
PRIOR ART
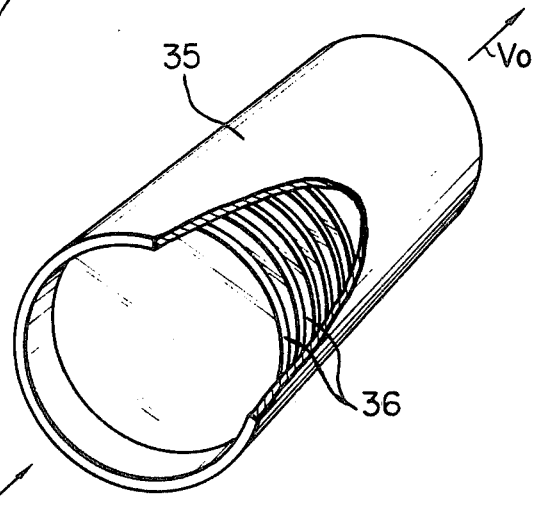
FIG. 4
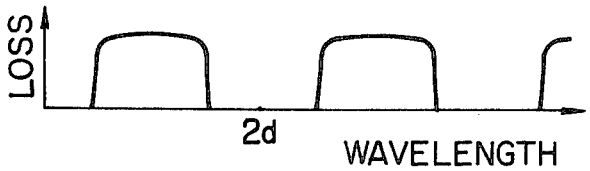

QUASIOPTICAL BAND REJECTION FILTER

BACKGROUND OF THE INVENTION

This invention relates to a band rejection filter, utilizing optical principles, which is employed in a diplexer or filter in the millimeterwave and submillimeter-wave transmission.

It is known in the art that a circuit of a small loss can be obtained by utilizing optical principles for electromagnetic waves of short wavelengths, and this technique has already been employed in diplexers for the millimeterwave transmission, for example, in a Michelson-interferometer type band-splitting filter, a filter using dielectric disks for suppression of the leakage of transmitter signals into receiving paths. However, these circuits have the defects of bulkiness and complexity in construction. That is, for the purpose of splitting frequency bands, the band-splitting filter employs a cutoff filter which permits the passage therethrough of electromagnetic waves of a frequency above a predetermined value, so that a tapered waveguide as long as 200 to 500 mm is required for the connection of the cutoff filter with an oversized waveguide. Accordingly, this conventional diplexer is very bulky.

A band rejection filter is usually employed as a filter for suppression of the leakage of transmitter signals into receiving paths, but since no quasioptical band rejection filter has been obtainable with the prior art, a low-pass filter is used instead. In the millimeterwave transmission system, however, use is made of a low-pass filter of the type which does not utilize the frequency band, for instance, below 40 GHz but uses the frequency band below 70 GHz as a pass band. As a result of this, the pass band becomes unnecessarily wide and, at the same time, the cutoff response of the frequency response is degraded, so that it is necessary to increase the number of cavities forming the low-pass filter. This inevitably increases the accuracy of fabrication and the cost of the filter and makes the filter bulky.

Further, there has been proposed a band-splitting filter employing two 3 dB hybrids and two quasioptical low-pass filters of the same characteristic. Since the frequency characteristic of this filter has ripples in the pass bands, and consequently the cutoff response is not so sharp, the number of cavities making up each low-pass filter must be increased, which makes the filter large and raises the accuracy of its fabrication and its cost.

Also in the fields of radio astronomy and plasma diagnostics of the millimeterwave and submillimeter-wave bands other than the millimeterwave transmission, a diplexer and a filter are required. But the conventional diplexer and filter have also the same defects as mentioned above.

An object of this invention is to provide a band rejection filter utilizing optical principles.

Another object of this invention is to provide a quasioptical band rejection filter which is relatively simple in construction and sharp in cutoff response.

Another object of this invention is to provide a quasioptical band rejection filter which is easy to manufacture and adjust.

Still another object of this invention is to provide a quasioptical band rejection filter which enables easy construction of a diplexer or a filter for suppression of the leakage of transmitter signals into receiving paths.

SUMMARY OF THE INVENTION

According to this invention, one of ports of a 3 dB hybrid, which comprises a half mirror such as a dielectric plate or metal grid and passes one half of incident waves but reflects the other half, is used as an input port, and first and second resonators are electromagnetically coupled with two ports to which the incident waves from the input port are outputted after being divided by the half mirror. The first and second resonators respectively comprise pluralities of coupling disks sequentially arranged in the direction of travel of the waves to lie at right angles thereto and first and second reflectors respectively disposed opposite the outermost coupling disks on the opposite side from the hybrid. These coupling disks are dielectric disks or metal grids, and the distance between adjacent ones of the coupling disks is selected to be an integral multiple of about $\frac{1}{2}$ wavelength of the center frequency of the stop band desired to obtain, and each pair of adjacent coupling disks forms one cavity. The number of coupling disks of either one of the first and second resonators differs from that of the other by one, and consequently the number of cavities also differs by one. The distances between the hybrid and the first and second resonators are selected to be substantially the same. The remaining port of the hybrid is used as an output port. The electromagnetic waves incident to the input port are divided by the hybrid into two and then supplied to the first and second resonators, respectively. The electromagnetic waves are reflected by the reflectors of the resonators back to the hybrid, but since the numbers of cavities of these resonators are different from each other by one, the frequency components of the reflected waves in the vicinity of the resonance frequency are opposite in phase to each other at the side of the output port and are returned to the input port, and the other frequency components become in-phase with each other at the output port and are emitted therefrom. Thus a band rejection characteristic is obtained. In the case of providing the 3 dB hybrid in an over size waveguide, the first and second resonators are both formed with oversized waveguides of the same size and these waveguides are respectively coupled with waveguides of the hybrid mechanically and electromagnetically. In the Gaussian beam transmission, the 3 dB hybrid is formed with a half mirror alone, and each resonator is also made up with coupling disks and the reflector alone.

BRIEF DESCRIPTION OF THE DRAWINGS

FIG. 1 is a perspective view, partly cut away, showing a quasioptical band rejection filter considered obtainable with the prior art;

FIG. 2 is a plan view illustrating a conventional diplexer employing a cutoff filter;

FIG. 3 is a perspective view, partly cut away, a conventional quasioptical low-pass filter;

FIG. 4 is a graph showing the frequency characteristic of the quasioptical low-pass filter depicted in FIG. 3;

DETAILED DESCRIPTION OF THE INVENTION

Figure 5:
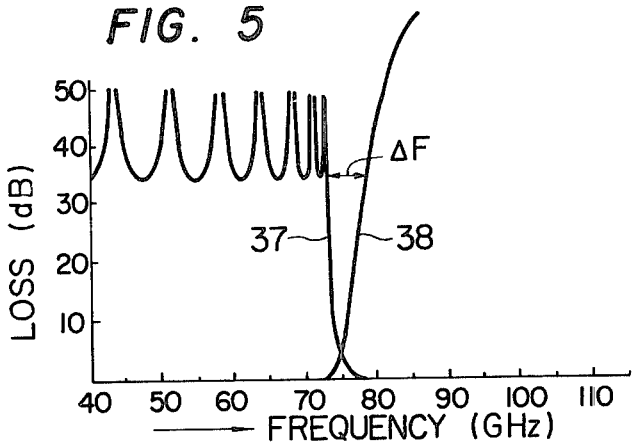
FIG. 5 is a graph showing its low-pass characteristic part.

For a better understanding of this invention, a description will be given first of the prior art. No quasioptical band rejection filter has been realized, as mentioned previously. Assuming that a conventional band rejection filter employing waveguides is applied to quasioptical circuits, oversized waveguides or waveguides 11 and 12 whose diameters are sufficiently larger than the working wavelength, are gradually diminished in diameter at one end with mode converters 13 and 14, respectively, and converted thereby into a dominant mode waveguide, and a band rejection filter 15 formed with the dominant mode waveguide is coupled between the mode converters 13 and 14, as illustrated in FIG. 1. The band rejection filter 15 has a plurality of cavities 17 disposed on one side of its waveguide 16 and arranged in its lengthwise direction. The cavities 17 are respectively coupled with the waveguide 16 through coupling holes 18. When those frequency components of electromagnetic waves $V_i$ incident from the waveguide 11 which are equal to the resonant frequency of the cavity 17 has entered into the waveguide 16, they are reflected by the cavity resonator 17 to be inhibited from the passage therethrough, but the other remaining frequency components are emitted as electromagnetic waves $V_o$ from the waveguide 12. In this fashion, the band rejection filter is constituted.

In the band rejection filter of such a construction as mentioned above, the mode converters 13 and 14 are each as long as 60 to 100 cm, so that the overall structure is very bulky. On top of that, the filter 15 using the dominant mode waveguide 16 presents problems of its small size in the millimeter and submillimeterwave bands to permit inaccurate machining operations and a marked increase in insertion loss with an increase in frequency. Because of these problems involved, the filter has not heretofore been put in practical use.

Accordingly, the diplexer that has hitherto been employed for the band-splitting purpose in the millimeter-wave transmission is such as illustrated in FIG. 2. This is set forth, for example, in International Conference on Millimetric Waveguide Systems, Nov. 9–12, 1976, Convention Records, pp. 147–150, "Band Diplexing in Overmode Rectangular Waveguide Technique", U. Unrau et al. Electromagnetic waves $V_i$ incident from an input port 21 of a first hybrid coupler 19 formed with an oversized waveguide is divided by the hybrid coupler 19 into two and transmitted to tapered waveguides 23 and 24 coupled with the hybrid 19. The other ends of the tapered waveguides 23 and 24 respectively have coupled thereto dominant mode cutoff filters 25 and 26 which permit the passage therethrough of frequencies above $f_1$. Accordingly, the frequency components below $f_1$ in the electromagnetic waves having reached the cutoff filters 25 and 26 are reflected and combined, thereafter being emitted as electromagnetic waves $V_{01}$ from an output port 27. On the other hand, the frequency components above $f_1$, which have passed through the cutoff filters 25 and 26, are converted by tapered waveguides 28 and 29 to an overmode, respectively pass through over size waveguides 31 and 32 and are then combined by a second hybrid coupler 33, thereafter being emitted as electromagnetic waves $V_{02}$ from its output port 34. The tapered waveguides 23, 24, 28 and 29 and the over size waveguides 31 and 32 are formed as substantially a square, unitary structure with one another as a whole.

Since the abovesaid conventional diplexer employs the tapered waveguides 23, 24, 28 and 29, the length $l_1$ of one side of the overall structure is as long as 200 to 500 mm, which inevitably makes the diplexer bulky.

Further, it is customary practice to employ, as a filter for suppression of the leakage of transmitter signals into receiving paths, a band rejection filter which rejects the frequency components of the transmitter signals, but since no quasioptical band rejection filter has heretofore been realized as referred to previously, such a low-pass filter as shown in FIG. 3 has been employed. The illustrated low-pass filter has the construction that a plurality of dielectric coupling disks 36 are disposed in an oversized waveguide 35 perpendicularly to its axis and arranged in its axial direction. This low-pass filter has such a frequency characteristic as shown in FIG. 4 in which the pass bands of the filter are a low-frequency band including DC components, a frequency band that the spacing between adjacent ones of the coupling disks 36 is equal to ½ the wavelength and the frequency bands of integral multiples of the abovesaid band. In other words, those of the frequency components of the incident electromagnetic waves $V_i$ which are equal to the resonant frequency of the resonator formed with the coupling disks 36 are emitted as output electromagnetic waves $V_o$. In FIG. 4, reference numeral d indicates the spacing of the coupling disks 36. The frequency characteristic of the low-pass characteristic part of the abovesaid frequency characteristic is shown in detail in FIG. 5. The reflection characteristic curve 37 is a characteristic having ripples in the pass bands, but the pass characteristic curve 38 is a characteristic having no ripples in the stop bands. The cutoff response of the filter of such a characteristic having ripples only in the pass bands is not so sharp as compared with the filter having ripples both in the pass bands and stop bands.

Accordingly, as disclosed, for instance, in IEEE Transaction on Microwave Theory and Technique, Vol. MTT-22, No. 12, December 1974, pp. 1202–1209, "A class of waveguide filter for over-moded applications", Chung-Li Ren et al, if use is made of a low-pass filter having a pass band below 75 GHz and a stop band above it and if the amount of interference waves to be rejected is selected to be 35 dB, for example, the number of cavities formed with the coupling disks is required to be as large as 22, so that the filter becomes large and is troublesome to manufacture and adjust. As shown in FIG. 4, this filter constitutes a band rejection filter between adjacent ones of the pass bands, but since its frequency characteristic has ripples only in the pass bands, the frequency response is not so sharp and, on top of that, it is difficult to narrow the stop band width. Because of these problems involved, this filter is not used as a band rejection filter.

Figure 6:
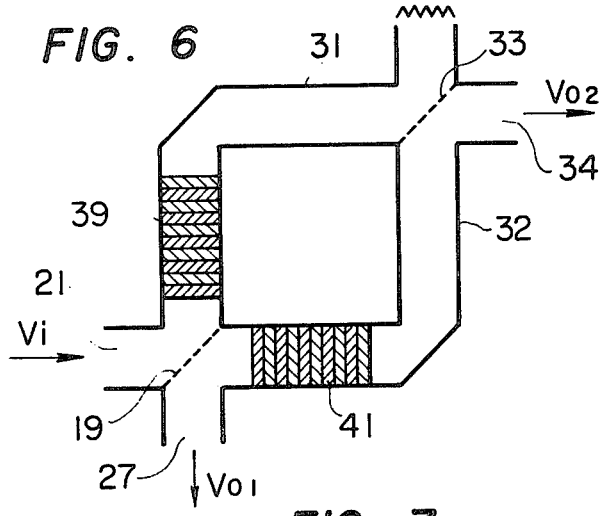
FIG. 6 is a schematic diagram showing the principles of a conventional diplexer employing a low pass filter.

The use of a low-pass filter as a conventional quasioptical diplexer is proposed in a West German magazine "Archiv für Elektronik und Übertragungstecknik", January, 1971, Vol. 25, No. 1, pp. 56–57, U. Unrau, "Periodic Band Multiplexer for $TE_{01}$-Telecommunication System". According to this, as shown in FIG. 6, electromagnetic waves $V_i$ incident from an input port 21 of a first hybrid 19 formed with an over size waveguide are divided into two, which respectively enter low-pass filters 39 and 41 of the same characteristic and coupled to the hybrid 19. The filters 39 and 41 are identical in construction with that shown in FIG. 3. The frequency components above their cutoff frequency $f_1$ are reflected by the filters 39 and 41, respectively, and emitted as electromagnetic waves $V_{01}$ from an output port 27 of the hybrid 19. On the other hand, the frequency components below the cutoff frequency $f_1$, which have passed through the filters 39 and 41, respectively, pass through over size waveguides 31 and 32 and are combined by a second hybrid 33, thereafter being emitted as electromagnetic waves $V_{02}$ from an output port 34 of the second hybrid 33.

The diplexer can be constructed smaller than that illustrated in FIG. 1, but the frequency characteristics of the filters 39 and 41 have ripples only in the pass bands, and then their frequency response is not so sharp. To make the cutoff response sharp, it is necessary to increase the number of resonance stages of each of the filters 39 and 41, which makes their manufacture and adjustment troublesome and raises the manufacturing cost.

Figure 7:
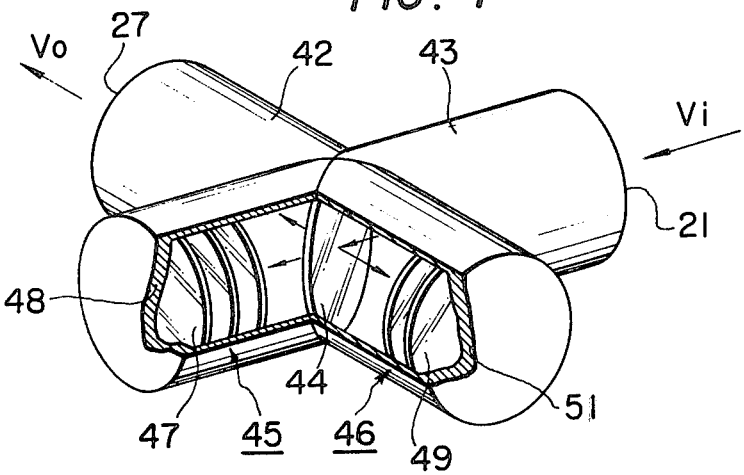
FIG. 7 is a perspective view, partly cut away, illustrating an example of a quasioptical band rejection filter of this invention formed with oversized waveguides.

FIG. 7 illustrates an example of a quasioptical band rejection filter of this invention which employs over size waveguides. Two oversized waveguides 42 and 43 of the same configuration are coupled together to cross each other at right angles, and a half mirror 44 such as dielectric disk or a metal grid is disposed at the intersection of the both waveguides at an angle of 45° to their axes, forming a 3 dB hybrid 19. The 3 dB hybrid 19 itself can be made to be of the same construction as the known ones. One port of the hybrid 19, in this example, one end of the waveguide 43, is used as an input port 21. There are provided resonators 45 and 46 in two ports from which electromagnetic waves incident from the input port 21 are emitted after being divided by the hybrid 19 into two, that is, in the other end portion of the waveguide 43 and one end portion of the waveguide 42. The resonator 45 is formed by arranging a plurality of coupling disks 47 such as dielectric disks or metal grids in the waveguide 43 at right angle to its axis and by short-circuiting the opposite end portion of the waveguide 43 from the input port 21 with a reflector 48.

In a similar manner, the resonator 46 is also formed by arranging a plurality of coupling disks 49 such as dielectric disks or metal grids in the waveguide 42 at right angles to its axis and by short circuiting the opposite end portion of the waveguide 42 from the hybrid 19 with a reflector 51. The spacing between adjacent ones of the coupling disks 47 and 49 is selected to be substantially equal to an integral multiple of ½ the wavelength of the center frequency of the stop band desired to obtain, and each pair of adjacent ones of the coupling disks constitute one resonance stage. The number of coupling disks of either one of the resonators 45 and 46 is different from that of the other by one, and therefore the number of resonance stages is also different by one. In the illustrated example, the coupling disks 47 of the resonator 45 are three, and the coupling disks 49 of the resonator 46 are two. The remaining port of the hybrid 19, that is, the end of the waveguide 42 on the opposite side from the resonator 46 is used as an output port 27. The distances from the hybrid 19 to the resonators 45 and 46 are selected to be substantially equal to each other. The resonators 45 and 46 themselves can be made to have the same construction as the heretofore known one.

Figure 8:
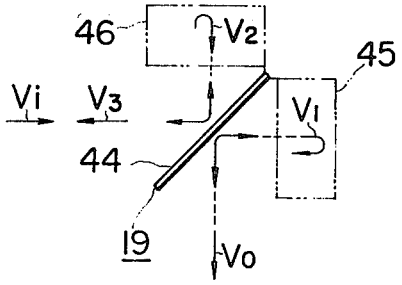
FIG. 8 is a schematic diagram explanatory of the operation of the quasioptical band rejection filter of this invention exemplified in FIG. 7.

With the structure shown in FIG. 7, the electromagnetic waves $V_i$ incident from the input port 21 are divided by the 3 dB hybrid 19 into two and then fed to the resonators 45 and 46, respectively, as schematically illustrated in FIG. 8. Letting $\phi_1$ and $\phi_2$ represent the phases of electromagnetic waves $V_1$ and $V_2$ respectively reflected by the resonators 45 and 46 back to the hybrid 19, the phase of an electromagnetic wave $V_3$ reflected back to the input port 21 is $e^{-j\phi 2}-e^{-j\phi 1}/2$, whereas the phase of the electromagnetic wave $V_0$ emitted from the output port 27 is $e^{-j\phi 1}+e^{-j\phi 2}/2$. Where the reflected waves $V_1$ and $V_2$ from the two resonators 45 and 46 are of the same phase, their phase is such that $|e^{-j\phi 1}+e^{-j\phi 2}/2|=1$, and the incident waves $V_i$ all pass to the output port 27. Where the reflected waves $V_1$ and $V_2$ are opposite in phase to each other, the incident waves $V_i$ are all reflected and no output appears at the output port 27.

Figure 9:
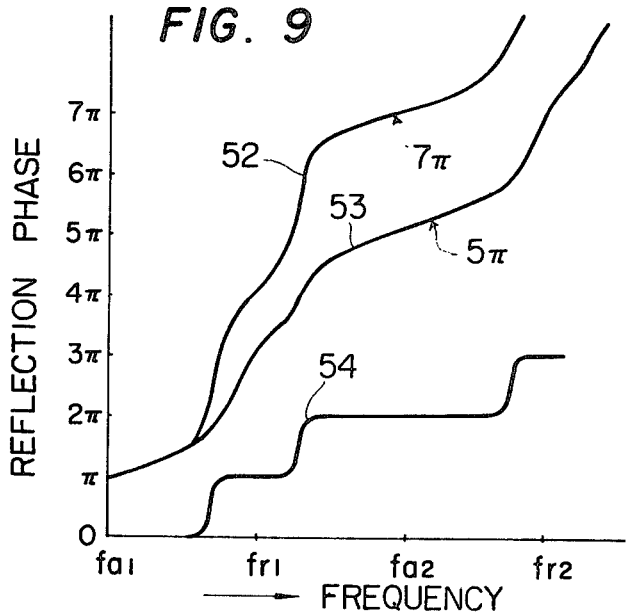
FIG. 9 is a graph showing the reflection phase characteristics of resonators utilized in the example depicted in FIG. 7.

Incidentally, the resonators 45 and 46 operate as a harmonic resonator and its resonance periodically occurs on the frequency axis. The reflection phases $\phi_1$ and $\phi_2$ of the resonators 45 and 46 respectively vary by $2N\pi$ (N being the number of resonance stages) every passage through the resonance point on the frequency axis. Since the difference in the number of resonance stages between the resonators 45 and 46 is one, the relative phase $\phi_1-\phi_2$ of the reflected waves $V_1$ and $V_2$ varies by $2\pi$ every passage through the resonance point or between two adjacent anti-resonance points on the frequency axis. Further, since the both resonators 45 and 46 are spaced an equal distance from the hybrid 19, the relative phase $\phi_1-\phi_2$ of the reflected waves $V_1$ and $V_2$ near each anti-resonance point on the frequency axis is always 0 or an integral multiple of $2\pi$, and the relative phase $\phi_1-\phi_2$ at each resonance point on the frequency axis is always $\pi$ or odd times of $\pi$ because the frequency response of the reflection phases is periodic and odd-symmetrical about each resonance point. In other words, the electromagnetic wave of the frequency at each resonance point is reflected back to the input port side, and the electromagnetic wave of the frequency in the vicinity of each anti-resonance point is permitted to pass to the output port side. For instance, in the case where the resonators 45 and 46 have three and two cavities, respectively, as in the illustrated example, the band rejection filter exhibits such reflection phase characteristics as shown in FIG. 9. In FIG. 9, the abscissa represents frequency and the ordinate the reflection phase. The curve 52 indicates the reflection phase characteristic of the resonator 45, and the phase $\phi_1$ is $4\pi$ at a first-order resonant frequency $f_{r1}$ and $\pi$ and $7\pi$ at first and second-order anti-resonance frequencies of $f_{a1}$ and $f_{a2}$, respectively. That is, the phase $\phi_1$ varies by $2\times 3\pi=6\pi$ between the anti-resonance frequencies $f_{a1}$ and $f_{a2}$. The curve 53 shows the reflection phase characteristic of the resonator 46, and the phase $\phi_2$ is $3\pi$ at the first-order resonance frequency $f_{r1}$ and $\pi$ and $5\pi$ at the first- and second-order anti-resonance frequencies $f_{a1}$ and $f_{a2}$, respectively. That is, the phase $\phi_2$ changes by $2\times 2\pi=4\pi$ between the anti-resonance frequencies $f_{a1}$ and $f_{a2}$.

The relative phase of the both reflected waves $V_1$ and $V_2$ of the resonators 45 and 46 is such as indicated by the curve 54, and is $\pi$ at the first-order resonance frequency $f_{r1}$ and 0 and $2\pi$ at the first- and second-order anti-resonance frequencies $f_{a1}$ and $f_{a2}$, respectively. Accordingly, the band centering about the frequency $f_{r1}$ becomes a stop band that the frequency components therein do not appear at the output port, and the bands centering about the frequencies $f_{a1}$ and $f_{a2}$, respectively, become pass bands that the frequency components appear at the output port.

Figure 10:
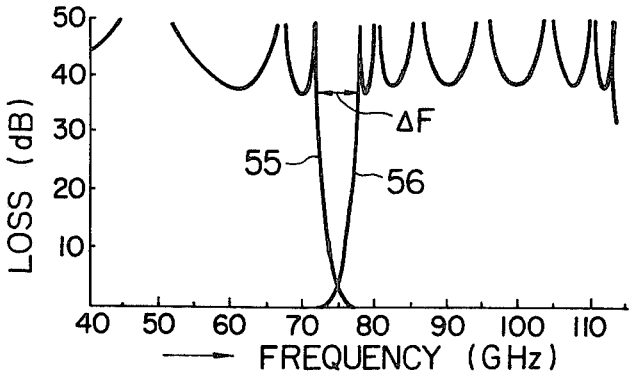
FIG. 10 is a graph showing the frequency characteristic of the band rejection filter illustrated in FIG. 7.

It has been found logically that the effective number of cavities of this band rejection filter is equal to the sum of the numbers of cavities of the two resonators 45 and 46. Accordingly, the illustrated example presents a response characteristic of $2+3=5$th-order elliptic function type filter. This band rejection filter exhibits reflection and pass characteristics such, for example, as indicated by the curves 55 and 56, respectively, in FIG. 10 in which the abscissa represents frequency and the ordinate loss, and the both characteristics have ripples in the pass bands and the stop bands, respectively. In other words, the band rejection filter shows the frequency characteristic having ripples in both pass and stop bands and exhibits a sharp frequency response. FIG. 10 corresponds to FIG. 5 and shows, by logical calculations, that the frequency characteristic is obtained with the use of the resonators 45 and 46 having three and four cavities together totalling seven cavities in the case where the amount of interference waves to be suppressed is $-35$ dB and the spacing between the reflection characteristic curve 55 and the pass characteristic curve 56 at $-35$ dB, that is, the socalled guard band $\Delta F$ is equal to that in FIG. 5.

Figure 11:
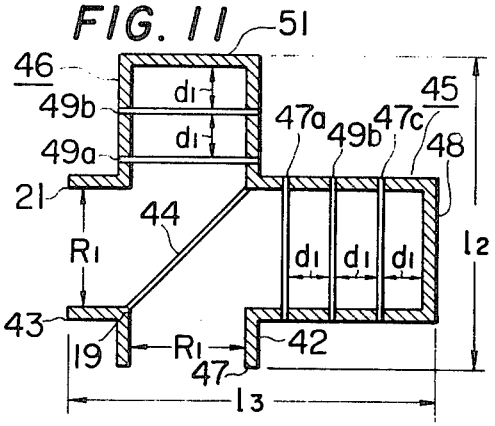
FIG. 11 is a sectional view illustrating an example of the band rejection filter of this invention produced as a trial.
Figure 12:
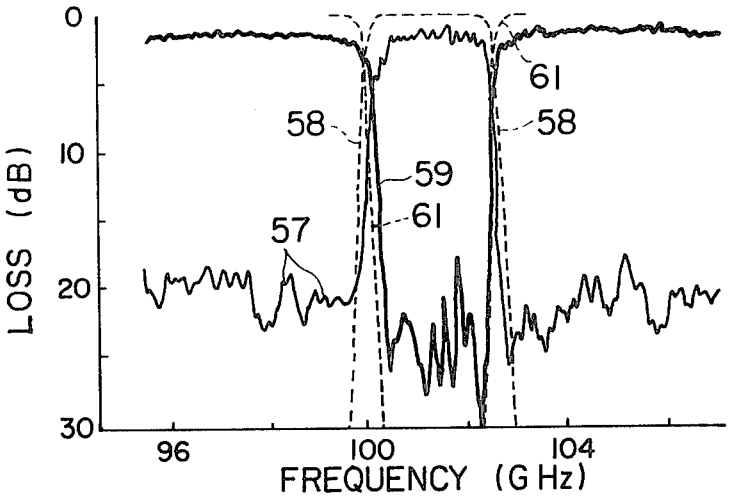
FIG. 12 is a graph showing measured and theoretical values of the frequency characteristic of the filter depicted in FIG. 11.

FIG. 11 illustrates a specific operative example of the band rejection filter of 100 GHz. In this example, waveguides 42 and 43 both have an inner diameter $R_1$ of 28 mm, and their lengths $l_2$ and $l_3$ are 115 mm and 135 mm, respectively. The distance $d_1$ between adjacent ones of coupling disks is about 18 mm, and a half mirror 44 forming the hybrid 19 is made of fused quartz. The resonator 45 comprises, as coupling disks, a polyester disk 47*a*, an alumina disk 47*b* and a fused quartz disk 47*c* arranged in this order from the side of the hybrid 19. The resonator 46 comprises, as coupling disks, a fluoric resin disk 49*a* and a fused quartz disk 49*b* arranged in this order from the side of the hybrid 19. The frequency response of this filter produced as a trial is shown in FIG. 12 in which the abscissa represents frequency and the ordinate loss. The curve 57 indicates a measured value of the reflection characteristic and the curve 58 its theoretical value. The curve 59 indicates a measured value of the pass characteristic and the curve 61 its theoretical value. The measured values and the theoretical ones agree well with each other, which indicates that the filter of this invention exhibits desired characteristics. In this experiment, the insertion loss is about 1.5 dB, but it can be expected theoretically to reduce the insertion loss to 0.2 dB or so by using square $TE_{10}$ over size waveguides as the waveguides 42 and 43, even in the case of a filter of the same size as mentioned above.

Figure 13:
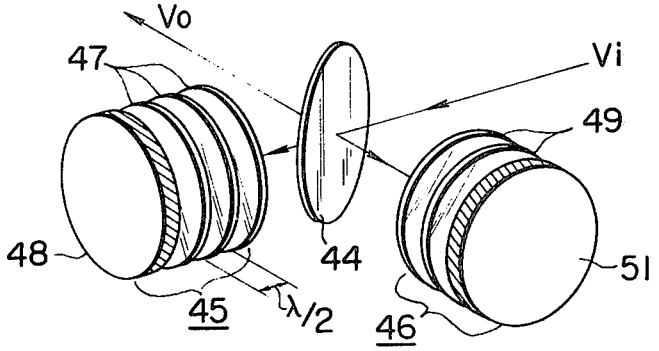
FIG. 13 is a perspective view illustrating an embodiment of this invention as being applied to a Gaussian beam mode.

Although this invention has been described as being applied to an over size waveguide circuit, the invention is also applicable to a circuit using a Gaussian beam. An example of its application is illustrated in FIG. 13, which the parts corresponding to those in FIG. 7 are identified by the same reference numerals. In this instance, the oversized waveguides 42 and 43 in FIG. 7 are removed and only their inner elements are used. As it will be understood that this circuit also performs the same operations as described above, no description will be given. In the case of the beam mode, the insertion loss is very low.

Figure 14:
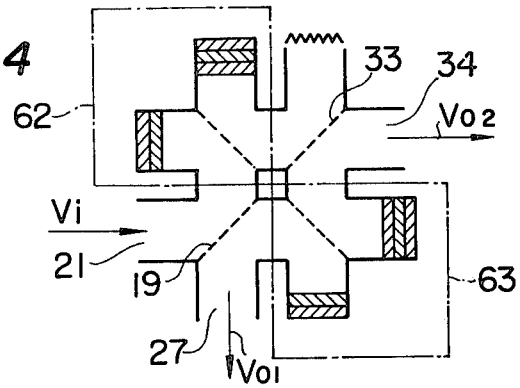
FIG. 14 is a diagram illustrating a diplexer formed with the band rejection filter of this invention.

In a diplexer using the quasioptical band rejection filters of this invention, electromagnetic waves incident from an input port 21 of a first hybrid 19 are divided into two and supplied to quasioptical band rejection filters 62 and 63 of the same characteristic according to this invention, as shown, for instance, in FIG. 14. The frequency components in the stop bands of these filters 62 and 63 are reflected thereby back to the hybrid 19 and combined with each other and emitted as the electromagnetic wave $V_{01}$ from an output port 27. On the other hand, the electromagnetic waves having passed through the filters 62 and 63, respectively, are combined and then emitted as the electromagnetic wave $V_{02}$ from an output port 34.

As has been described in the foregoing, it is possible with this invention to obtain a band rejection filter heretofore unobtainable as a circuit utilizing optical principles. On top of that, its frequency characteristic has ripples in both pass and stop bands, so that the cutoff response is sharp. Accordingly, if a filter for suppression of the leakage of the transmitter signals into the receiving paths in the millimeter transmission is produced by utilizing such sharp cutoff response, even if the transmitting and receiving frequencies are relatively close to each other, interference with each other can be suppressed sufficiently small. In such a case, if a conventional low-pass filter is employed, the number of cavities required is as large as 22, as described previously with respect to FIG. 5, but if the filter of this invention is used, a filter of the same characteristic as the above can be obtained with seven cavities. Thus the cavities are small in number and formed in the two resonators 45 and 46, respectively, so that the manufacture and adjustment are very easy.

In the application of the filter of this invention to a diplexer, the number of cavities of the resonators may be about $\frac{1}{2}$ of the number of cavities required in the diplexer using conventional filters in FIG. 6, as shown in FIG. 14. Further, the resonators 45 and 46 are disposed not in the central part of the circuit but at the end portions thereof, so that the frequency response and the balance between the two filters 62 and 63 are very easy to adjust. The filter shown in FIG. 1 suffers from a large conduction loss due to the skin effect because of the employment of the dominant mode waveguide, but the filter of this invention is almost free from such conduction loss because of the use of the oversize waveguides or beam mode. Moreover, this invention employs dielectric disks or metal grids, but their loss is small, so that the insertion loss of the filter is small.

In the filter shown in FIG. 1, the resonator 17 is as small as about 1 to 2 mm at 100 GHz and its machining operation is required to be accurate to several $\mu$m, so that its fabrication is difficult, and it is almost impossible to adjust the coupling degree and the cavity spacing. With the filter of this invention, however, as the quasioptical principles are utilized, an over-moded operation is possible; namely the areas of the coupling disks can be increased at will, and the coupling degree is related to the thickness and material of the coupling disk, and it is possible to use a material which can be made to have a thickness easy to work, and the coupling degree can be freely changed with the thickness of the coupling disk. Further, the spacing can be easily adjusted.

In the filter shown in FIG. 1, since the coupling degree of the coupling holes 18 cannot be made high, Q of the resonator 17 increases to reduce the stop band to about 1% of its center frequency. With the filter of this invention, however, the coupling degree or the transmission factor of the coupling disk can be made 100% at maximum, and the stop band width can also be expanded up to 100% of its center frequency.

Since this invention neither involves the use of such tapered waveguides as employed in the diplexer shown in FIG. 2 nor requires mode exciters in the case of the beam mode, a diplexer can be made small.

The cutoff response of the filter can be made sharp by a suitable selection of the coupling degree of each coupling disk. Further, the cutoff response can be made sharp as a whole by increasing the number of cavities as in the prior art. The number of cavities of either one of the resonators may also be reduced to one. Also, it is possible that the difference between the distances from the hybrid to the two resonator is selected to be an integral multiple of ½ the wavelength of the center frequency of the stop band.

It will be apparent that many modifications and variations may be effected without departing from the scope of the novel concepts of this invention.

What is claimed is:

1. A quasioptical band rejection filter comprising:

a 3dB hybrid for dividing and combining electromagnetic waves, one of ports of the hybrid being used as an input port;

a first resonator electromagnetically coupled with one of two ports of this hybrid to which the electromagnetic waves incident from the input port are outputted after being divided, the first resonator comprising a plurality of opposed coupling disks sequentially arranged in the direction of travel of the electromagnetic waves and a first reflector disposed opposite the last one of the coupling disks; and a second resonator electromagnetically coupled with the other output port and comprising a plurality of opposed coupling disks sequentially arranged in the direction of travel of the electromagnetic waves and a second reflector disposed opposite the last one of the coupling disks, the number of coupling disks of the second resonator being larger than that of the first resonator by one;

the remaining port of the hybrid being used as an output port.

2. A quasioptical band rejection filter according to claim 1, wherein the 3 dB hybrid is formed in the intersection of oversized waveguides coupled to cross each other at right angles, wherein the pluralities of coupling disks are respectively inserted and held in the oversized waveguides on one side of the hybrid, and wherein the end faces of the oversized waveguides on the sides of the coupling disks being inserted are short-circuited with first and second reflectors, respectively.

3. A quasioptical band rejection filter according to claim 1, wherein the hybrid and the first and second resonators are constructed for use in the beam mode.

4. A quasioptical band rejection filter according to claim 1, wherein the hybrid is formed with a half mirror which reflects one half of the incident waves and passes therethrough the other half.

5. A quasioptical band rejection filter according to claim 1, wherein the coupling disks are dielectric disks.

6. A quasioptical band rejection filter according to claim 1, wherein the distances between the first and second resonators and the hybrid are selected to be substantially the same.

7. A quasioptical band rejection filter according to claim 1, wherein the spacing between adjacent ones of the coupling disks is selected to be an integral multiple of ½ the wavelength of a center frequency of a stop band.

* * * * *